United States Patent [19]

Mougin

[11] 4,191,491

[45] Mar. 4, 1980

[54] CREATING AND MAINTAINING A POOL OF FRESH WATER ON A TABULAR ICEBERG

[75] Inventor: Georges L. Mougin, Paris, France

[73] Assignee: ITI Limited, Paris, France

[21] Appl. No.: 884,406

[22] Filed: Mar. 8, 1978

[30] Foreign Application Priority Data

Mar. 15, 1977 [FR] France ..... 77 07596

[51] Int. Cl.[2] ..... E02B 1/00

[52] U.S. Cl. ..... 405/52; 405/61; 405/130; 405/217

[58] Field of Search ..... 61/1 R, 34, 36 A, 103; 405/52, 61, 130, 217

[56] References Cited

U.S. PATENT DOCUMENTS

| | | | |
|---|---|---|---|
| 3,289,415 | 12/1966 | Merrill | 61/1 R |
| 3,931,715 | 1/1976 | Fitch et al. | 61/103 |
| 4,075,964 | 2/1978 | Sjogren | 61/103 X |

OTHER PUBLICATIONS

Ocean Industry, Mar. 1973, pp. 28, 29.

*Primary Examiner*—David H. Corbin
*Attorney, Agent, or Firm*—George E. Kersey

[57] ABSTRACT

Tabular icebergs can be used as a source of fresh water in arid regions if they are transported from the Antarctic to where there is a need for water. To help reduce the rate at which solar radiation melts the iceberg on its journey, pools of fresh water are maintained on its upper surface, thereby taking advantage of the fact that the latent heat of evaporation of water is about seven times that of fusion of ice. The pools are created by protecting a closed path on the surface of the iceberg from melting by means of flexible sheet material. The protected path then forms the walls of the pool. At its destination the iceberg's pools can be given a V-shaped bottom to help increase the rate at which the iceberg is turned into fresh water.

10 Claims, 3 Drawing Figures

Fig. 1
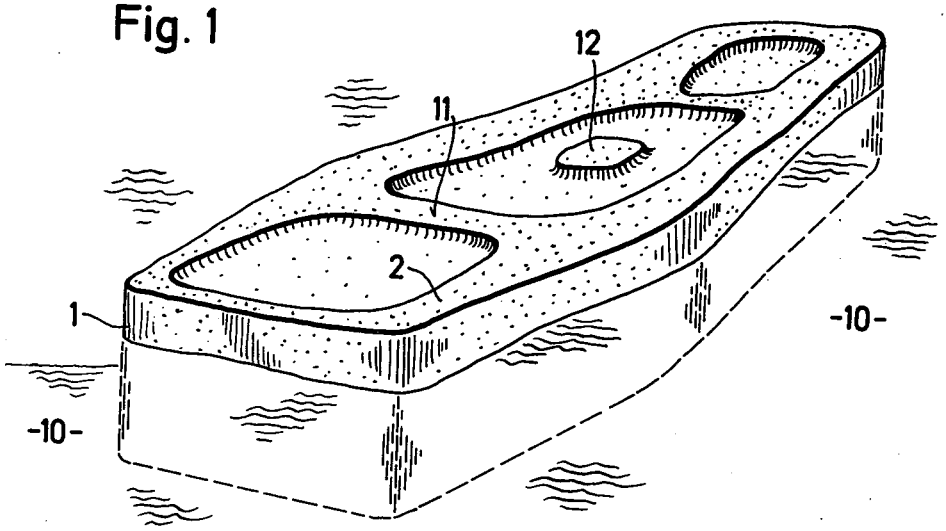
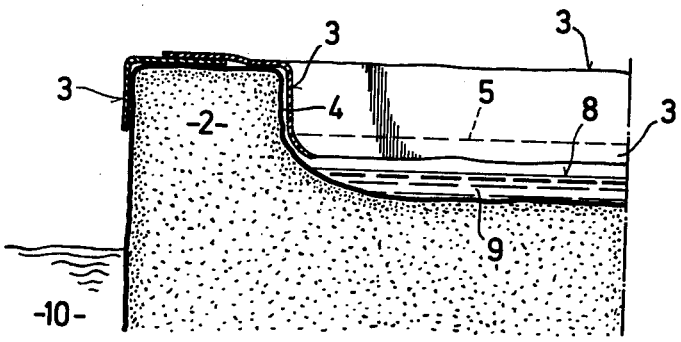
Fig. 2
Fig. 3
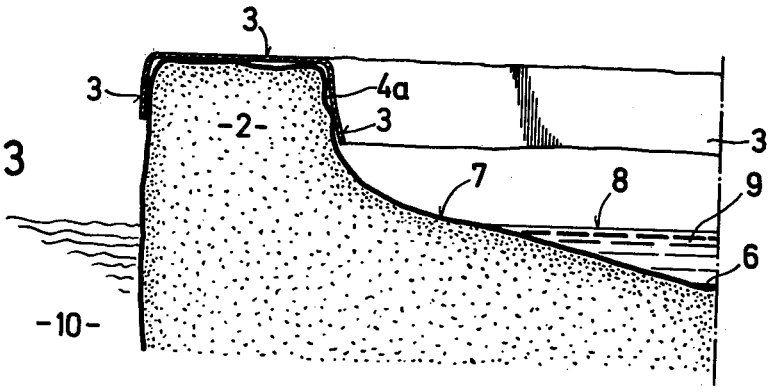

CREATING AND MAINTAINING A POOL OF FRESH WATER ON A TABULAR ICEBERG

The present invention relates to creating and maintaining a pool of fresh water on the substantially horizontal upper surface of a tabular iceberg.

Tabular icebergs originate exclusively in the Antarctic, where the ice advances in the form of a plateau with a well defined frontier where it meets the sea, rather than as tongues of ice. The Antarctic continent is not surrounded by mountains, but is ringed by a rim of ice, part of which is supported on the continental shelf and the rest of which floats on the sea. Under the pressure of the ice inland, this mass of ice is slowly pushed towards the sea, and from time to time tabular icebergs become detached from it. These can be very large, covering an area of several tens of square kilometres. They can nevertheless be towed to the offshore waters of the Earth's dry regions. The vertical dimension of the submerged portion of a rectagular tabular iceberg is six to eight times the height above sea level, and the total thickness is around 250 to 300 meters.

It is necessary to prevent the iceberg melting during its journey, whether it is towed or self-propelled by means of underwater propulsion units attached to the substantially horizontal lower surface of the iceberg by a method disclosed elsewhere by the present applicants. It is also necessary to control the melting of the iceberg when it arrives at the tropical dry region where it is to be used, in order to recover as much of its volume as possible in the form of fresh water. In accordance with the invention these apparently contradictory requirements are resolved by the creation of a pool of fresh water on the substantially horizontal upper surface of the iceberg.

The result of creating and maintaining a pool for the collection of fresh water on the substantially horizontal upper surface of a tabular iceberg is that the natural melting of the upper part of the iceberg is slowed down during the journey across the ocean, since the latent heat of evaporation of water is seven times the latent heat of fusion of ice. The solar energy is thus absorbed by evaporating the water in the pool on the substantially horizontal upper surface of the iceberg, this pool also serving to collect rainwater, especially in tropical waters. This at least partially compensates for the loss of water by evaporation. The pool also stores the water produced by the melting of the upper part of the iceberg.

The creation and maintenance, in accordance with the invention, of a pool on the substantially horizontal upper surface of a tabular iceberg also has the effect, during the use of the iceberg off the shores of the dry region which is its destination, after its journey across the ocean, of regulating the rate at which water is produced by the melting of the ice exposed to solar radiation, and of providing a means of storing the water produced by the melting of the iceberg.

A remarkable feature of the invention is that the pool hollowed out of the substantially horizontal upper surface of a tabular iceberg is used both to limit the melting of the iceberg and to provide a means of storing the water produced by such melting. Thus, unlike certain proposed solutions to the problem of obtaining fresh water from icebergs, which rely on the use of an enclosure around the iceberg forming a reservoir in which the melted ice is collected, the invention uses the iceberg itself as a reservoir.

The invention is intended to provide a pool for the collection of fresh water, hollowed out from the substantially horizontal upper surface of a tabular iceberg. The pool is formed by slowing down the melting of the iceberg along a closed path defining the pool. To this end, at least one flexible insulative sheet, such as a metallised plastics film, is unrolled along the closed path defining the pool. The bottom of the pool is V-shaped or U-shaped, depending on whether it is a question of slowing down the melting of the iceberg by storing water on its surface or of facilitating its melting. The bottom of the pool is shaped by deploying at least one flexible insulative sheet on the surfaces where melting is to be slowed down for varying periods.

The invention also consists in a method of regulating the melting of a tabular iceberg having hollowed out of its substantially horizontal upper surface a pool for collecting fresh water, the pool being V-shaped in cross-section and storing the water produced by the melting of the underwater sections of the bottom of the pool.

The invention will now be described in more detail and by way of example only, with reference to the accompanying diagrammatic drawings, in which:

FIG. 1 is a perspective view of a tabular iceberg comprising pools in accordance with the invention;

FIG. 2 is a partial cross-section through a tabular iceberg comprising a U-shaped pool, during its journey to the offshore waters of a tropical dry region where it will be melted to produce fresh water; and FIG. 3 is a partial cross-section through a tabular iceberg comprising a V-shaped pool for producing fresh water in the offshore waters of a tropical dry region.

FIG. 1 is a perspective view of a tabular iceberg (1) during its journey to one of the Earth's tropical dry regions. Propulsion units attached to the substantially horizontal lower surface of the iceberg by a method disclosed elsewhere by the present applicants move the iceberg (1) floating in the sea (10) from the Antarctic to the offshore waters of the tropical dry region in which it is to be converted into fresh water.

FIG. 2 is a partial cross-section through an iceberg (1) with its upper edges (2) covered by at least one flexible insulative sheet (3) such as a metallised plastics film with a reflective upper surface. These sheets (3) are unrolled and fixed down around the perimeter of the upper surface of the iceberg (1), over a width of about ten meters.

As can be seen from FIG. 1, a number of pools are created, leaving paths (11) providing access from each side of the iceberg to the other. This compartmentation means that production and storage of water from the melted ice can proceed simultaneously. Islands (12) are produced in the same manner (i.e. by slowing down the melting of the upper part of the iceberg), for supporting the equipment and the crew's quarters. The relatively faster melting of the portions of the iceberg's upper surface not protected by the insulating sheets (3) and therefore exposed to solar radiation produces pools in which the fresh water produced by the melting of the upper part of the iceberg is stored. Each pool is relatively shallow, and is U-shaped in cross-section. The pools are formed in two stages: initially the flexible insulative sheets (3) are spread out on the substantially horizontal upper surface of the iceberg (1). This forms a pool with vertical walls (4) and a horizontal bottom (5), indicated in FIG. 2 by the dashed outline. The sheets (3) are then spread over the vertical walls (4) of the pool to prevent the hollowing out of the edges (2) of the pool by further melting.

The method in accordance with the invention can be used to provide relatively shallow flat-bottomed pools covering the major part of the surface of the iceberg (1), for protecting the iceberg during its journey from the Antarctic to the dry region where it is to be used, and pools with a substantially V-shaped cross-section (see FIG. 3) with a point (6) at the deepest point. By controlling the slope of the pool bottom (7), it is possible to ensure automatic and natural regulation of the melting of the iceberg (1) in accordance with the level of solar radiation. When solar radiation is at a peak, the iceberg (1) melts rapidly, which increases the level (8) of the water (9) contained in the pool, so that a smaller area of the pool bottom (7) is exposed to the radiation. When the level (8) of the water (9) produced by the melting of the iceberg (1) falls, because of increased consumption, for example, a greater proportion of the pool bottom (7) is exposed to the solar radiation, so that melting is accelerated. The proportion of the pool bottom (7) exposed to the solar radiation naturally depends on the slope of the bottom (7).

As the melting of the iceberg increases the depth of the pool, it is necessary to remove at least some of the sheets (3) so as to melt the edges (2) before they become dangerously high.

The claims defining the invention are as follows:

1. A method of reducing the melting of an iceberg due to solar radiation, which comprises the steps of:
   (a) producing a pool of fresh water in an upper surface of the iceberg; and
   (b) limiting the melting of said iceberg using an insulating sheet that extends around the edge of said pool and down the inside wall thereof.

2. A method according to claim 1 wherein said insulating sheet is unrolled on said upper surface of said iceberg.

3. A method according to claim 1 wherein a plurality of insulating sheets are used to control the melting of said iceberg.

4. A method according to claim 1 wherein said insulating sheet is made of metallized plastic film.

5. A method of creating and maintaining a pool of water on an iceberg, comprising the steps of:
   (a) providing an iceberg having a substantially horizontal upper surface; and
   (b) applying an insulating film along a closed path on said horizontal upper surface to permit solar radiation to form said pool by the melting of said iceberg within said closed path, with said film extending down the inside wall of said pool, the further melting of said iceberg being limited after said pool is formed because the heat of vaporization of the water of said pool is greater than the heat of fusion of ice in said iceberg.

6. A method of regulating the melting of an iceberg, comprising
   (a) creating a pool for water in an upper surface of the iceberg having an insulating sheet that extends around the edge of the pool and down the inside wall thereof;
   (b) providing said pool with a V-shaped cross-section; and
   (c) storing the water produced by the melting of said iceberg beginning at the bottom of said V-shaped cross-section.

7. In combination
   an iceberg having a pool of fresh water in an upper surface thereof; and
   an insulating sheet that extends around the edge of said pool and down the inside wall thereof;
   thereby to limit the melting of said iceberg due to solar radiation, since the water of said pool has a latent heat of vaporization which is greater than the latent heat of fusion of the ice of said iceberg.

8. A combination in accordance with claim 7 wherein said pool occupies more than fifty percent of the exposed surface of said iceberg.

9. A combination in accordance with claim 7 wherein said pool is surrounded by a substantially horizontal ledge of ice at the outermost edge of said iceberg.

10. A combination in accordance with claim 7 wherein said insulating sheet comprises a flexible metalized plastic film.

* * * * *